US005653245A

United States Patent [19]

Beard et al.

[11] Patent Number: 5,653,245

[45] Date of Patent: Aug. 5, 1997

[54] TOBACCO EXPANSION PROCESSES AND APPARATUS

[75] Inventors: Hoyt S. Beard; Lucas J. Conrad; J. Edward Crook; James E. Lovette, all of Winston-Salem; Robert Calvin Johnson, Advance; Donald A. Newton, Winston-Salem, all of N.C.; Hamid Neshan, Houston, Tex.

[73] Assignee: R. J. Reynolds Tobacco Company, Winston-Salem, N.C.

[21] Appl. No.: 550,413

[22] Filed: Oct. 30, 1995

Related U.S. Application Data

[62] Division of Ser. No. 163,049, Dec. 6, 1993, Pat. No. 5,469,872 .

[51] Int. Cl.[6] ..... A24B 3/18

[52] U.S. Cl. ..... 131/291; 131/296; 131/290; 122/35; 60/659; 126/273.5

[58] Field of Search ..... 131/291, 296, 131/290, 293; 122/35, 36, 37; 124/273.5

[56] References Cited

U.S. PATENT DOCUMENTS

| | | | |
|---|---|---|---|
| 1,897,815 | 2/1933 | Osenberg | 122/35 |
| 3,982,379 | 9/1976 | Gillis et al. | 60/659 |
| 4,165,012 | 8/1979 | Markwood | 131/291 |
| 4,235,250 | 11/1980 | Utsch | 131/291 |
| 4,258,729 | 3/1981 | de la Burde et al. | 131/291 |
| 4,289,148 | 9/1981 | Ziehn | 131/291 |
| 4,336,814 | 6/1982 | Sykes et al. | 131/291 |
| 4,388,932 | 6/1983 | Merritt et al. | 131/291 |
| 4,461,310 | 7/1984 | Ziehn | 131/291 |
| 4,531,529 | 7/1985 | White et al. | 131/291 |
| 4,554,932 | 11/1985 | Conrad et al. | 131/291 |
| 4,561,453 | 12/1985 | Rothchild | 131/291 |
| 4,962,773 | 10/1990 | White et al. | 131/291 |
| 5,012,826 | 5/1991 | Kramer | 131/291 |
| 5,031,644 | 7/1991 | Kramer | 131/291 |
| 5,065,774 | 11/1991 | Grubbs et al. | 131/291 |
| 5,095,923 | 3/1992 | Kramer | 131/291 |
| 5,483,977 | 1/1996 | Conrad et al. | 131/291 |

FOREIGN PATENT DOCUMENTS

| | | | |
|---|---|---|---|
| 602 944 A2 | 6/1994 | European Pat. Off. | 131/291 |

OTHER PUBLICATIONS

"Breathing New Life Into Tobacco Expansion"; *Tobacco International*, Mar. 1, 1993.

*Primary Examiner*—Aaron J. Lewis
*Assistant Examiner*—Charles W. Anderson

[57] ABSTRACT

This invention provides tobacco expansion processes and apparatus that can be employed for expanding tobacco at rapid throughput rates employing high pressure tobacco impregnation conditions. The processes and apparatus of the invention are particularly useful in tobacco expansion processes employing cycle times of less than 20–30 seconds; the use of preheated, prepressurized expansion agent such as propane; preheating of tobacco batches; and/or compression of tobacco within a high pressure impregnation zone for greatly improving use of available space in a high pressure impregnation vessel.

14 Claims, 9 Drawing Sheets

FIG. 8.
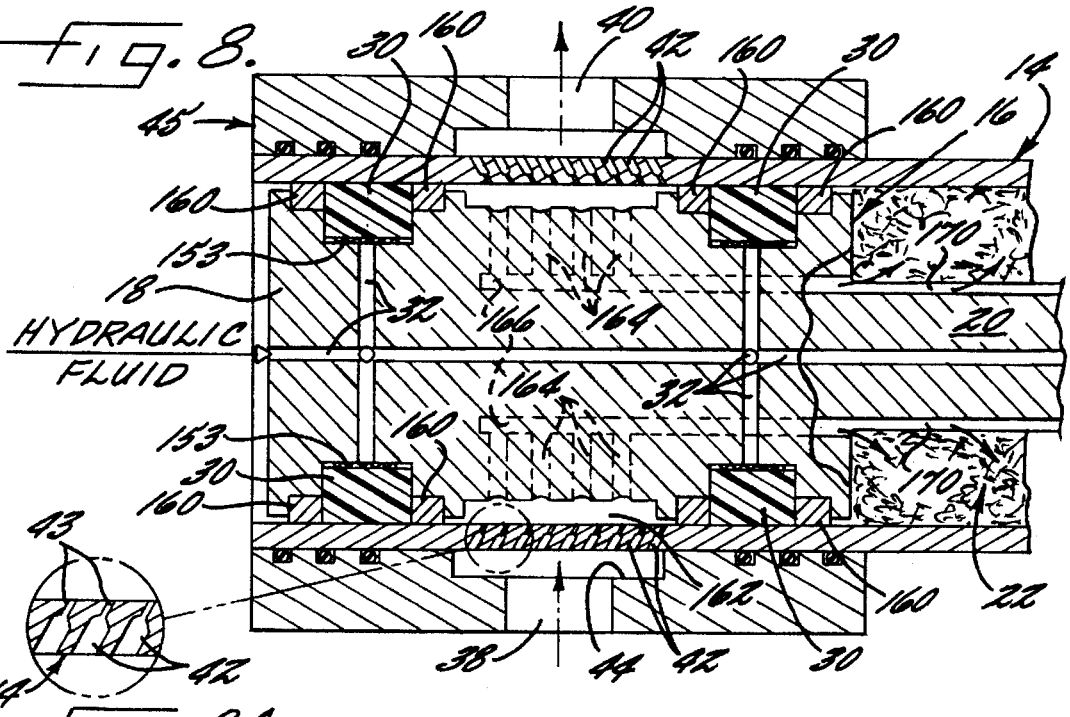
FIG. 8A.
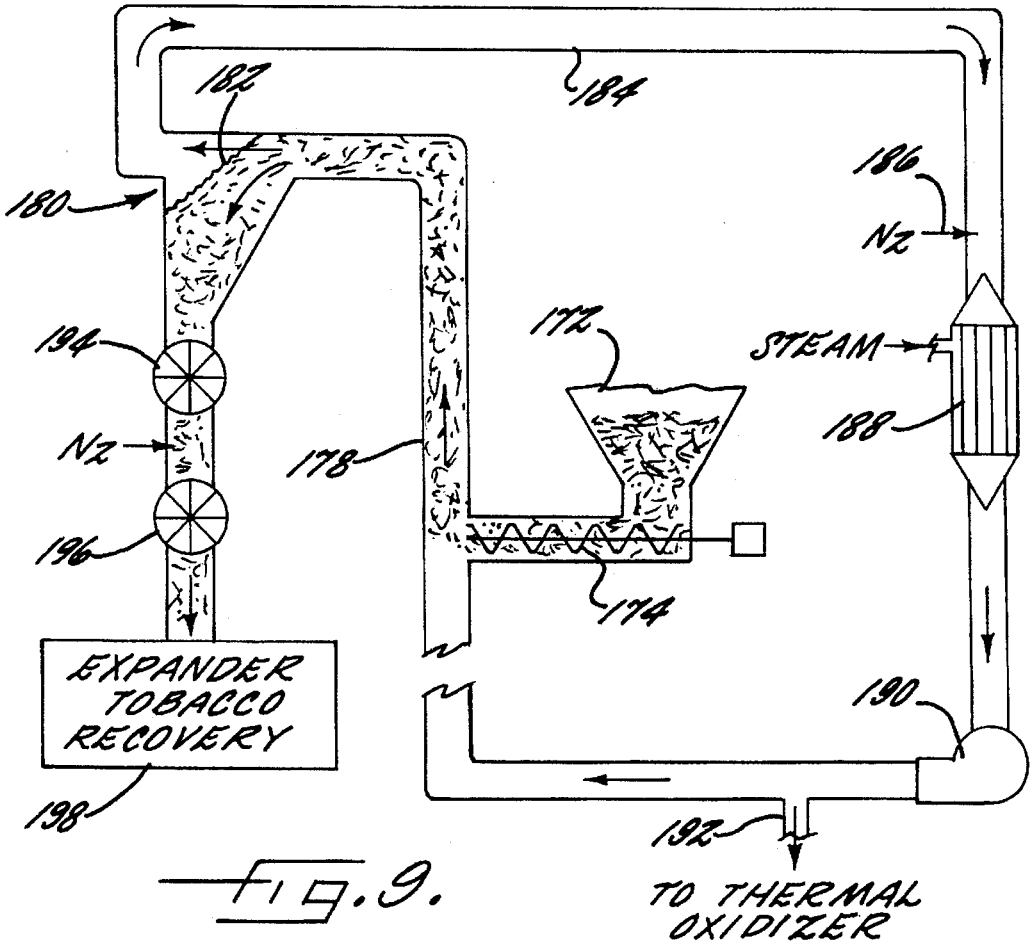
FIG. 9.

TOBACCO EXPANSION PROCESSES AND APPARATUS

RELATED APPLICATIONS

This application is a divisional of application Ser. No. 08/163,049 filed Dec. 6, 1993 now U.S. Pat. No. 5,469,872.

FIELD OF THE INVENTION

The invention relates to processes and apparatus for expanding tobacco. More particularly, the invention relates to processes and apparatus for improving throughput and economics of tobacco expansion.

BACKGROUND OF THE INVENTION

In the past two decades, tobacco expansion processes have become an important part of the cigarette manufacturing process. Tobacco expansion processes are used to restore tobacco bulk density and/or volume which are lost during curing and storage of tobacco leaf. In addition, expanded tobacco is an important component of many low tar and ultra-low tar cigarettes.

U.S. Pat. No. 3,524,451 to Fredrickson and U.S. Pat. No. 3,524,452 to Moser et al. describe processes in which tobacco is contacted with an impregnant and then heated rapidly to volatilize the impregnant and expand the tobacco. U.S. Pat. No. 3,683,937 to Fredrickson et al. discloses the vapor state impregnation of tobacco followed either by heating or rapid pressure reduction for tobacco expansion.

The use of a carbon dioxide for expanding tobacco is disclosed in U.S. Pat. No. 4,235,250 to Utsch; U.S. Pat. No. 4,258,729 to Burde et al.; and U.S. Pat. No. 4,336,814 to Sykes et al., among others. In these and related processes, carbon dioxide, either in gas or liquid form, is contacted with tobacco for impregnation and the impregnated tobacco is subjected to rapid heating conditions for expansion. In the known carbon dioxide expansion processes, it is typically necessary to heat the tobacco excessively in order to achieve substantial and stable expansion. This excessive heating can harm the tobacco flavor and/or generate an excessive amount of tobacco fines. In addition, those processes which use liquid carbon dioxide for impregnating tobacco typically result in impregnated tobacco in the form of solid blocks of tobacco containing dry ice, which must be broken up prior to heat treatment, thereby increasing the complexity of the process.

U.S. Pat. No. 4,388,932 to Merritt et al. discloses a process for increasing the post-reordering filling capacity of previously expanded tobacco. Previously expanded tobacco having an 'Oven Volatiles' (OV) content of less than 6 percent is heated to reduce its OV content to a value said to be well below 3 percent. The OV content of tobacco is said to be approximately equivalent to its moisture content since no more than 0.9 percent of tobacco weight is volatiles other than water. The very low OV content tobacco recovered from the post-expansion heating step is subjected to a reordering step for increasing its moisture content and is said to collapse less during the reordering step than if it were not heat treated after expansion. A stiffening of the tobacco during the heat treatment was proposed to account for the increased stability of the expanded tobacco during reordering.

U.S. Pat. No. 4,531,529 to White and Conrad describes a process for increasing the filling capacity of tobacco, wherein the tobacco is impregnated with a low-boiling and highly volatile expansion agent, such as a normally gaseous halocarbon or hydrocarbon at process conditions above or near the critical pressure and temperature of the expansion agent. The pressure is quickly released to the atmosphere so that the tobacco expands without the necessity of a heating step to either expand the tobacco or fix the tobacco in the expanded condition. The pressure conditions of this process range from 36 $Kg/cm^2$ (512 psi) and higher with no known upper limit. Pressures below 142 $Kg/cm^2$ (2,000 psi) were used to produce satisfactory tobacco expansion without excessive fracturing.

U.S. Pat. No. 4,554,932 to Conrad and White describes a fluid pressure treating apparatus, including a cylindrical tubular shell and a spool assembly mounted for reciprocal movement between a loading position outside the shell and a treating position within the shell. When the spool is within the shell, deformable sealing rings carried in annular grooves on the cylindrical ends of the spool are forced radially outwardly for engagement with the interior of the shell to form a pressure chamber within the shell between the spool ends. Conduits are provided to introduce processing fluids into the annular pressure chamber formed within the shell. The use of this apparatus for high pressure impregnation of tobacco with an expansion agent permits easy loading and unloading of tobacco and avoids the closure and opening problems associated with conventional pressure sealing and locking mechanisms, such as pivotable autoclave lids. This pressure vessel can thus produce time savings and improve economics in tobacco expansion.

Tobacco expansion processes including those described above and others, must be conducted in batch processes when impregnation pressures substantially above atmospheric pressure are used. The batch treating processes require complicated treating apparatus and long cycle times because of the time required in opening and closing the vessels and introducing and removing impregnating agent from the vessels. Some throughput improvements have been made by modifying the various apparatus employed to decrease cycle time; however, substantial throughput improvements in the known batch systems are available according to conventional techniques primarily by increasing volumes of the individual systems and/or increasing the number of batch systems used simultaneously.

SUMMARY OF THE INVENTION

This invention provides tobacco expansion processes and apparatus that can be employed for expanding tobacco at rapid throughput rates employing high pressure tobacco impregnation conditions. The processes and apparatus of the invention are particularly useful in conjunction with the processes and apparatus of U.S. patent application Ser. No. 08/076,535, filed Jun. 14, 1993, by Lucas J. Conrad and Jackie L. White, which provides for dramatically improving tobacco throughputs in high pressure tobacco impregnation systems. Those processes and apparatus typically involve tobacco impregnation and expansion cycle times of less than 20–30 seconds; the use of preheated, prepressurized expansion agent such as propane; preheating of tobacco batches; and/or compression of tobacco within a high pressure impregnation zone for greatly improving use of available space in a high pressure impregnation vessel.

In one aspect, the present invention substantially improves the degree of tobacco filling capacity increase in tobacco expansion processes using high pressure impregnation conditions. In other aspects, this invention provides rapid batch feed systems for reliably and economically feeding pre-sized tobacco batches to an impregnation zone and for rapidly and economically preheating tobacco batches. The invention also provides apparatus improvements for high speed/high pressure, spool-and-shell tobacco impregnation apparatus. Still further the invention provides an improved accumulator apparatus for the rapid generation and supply of high temperature/high pressure impregnation gasses, including flammable gasses such as propane. The improved accumulator both minimizes the mass of such gas present within the system at any given time and also eliminates costly and troublesome moving parts required in prior art accumulators.

Substantial improvement in tobacco filling capacity increase is obtained according to a first aspect of the invention by impregnating high moisture content tobacco with an expansion agent in a high pressure tobacco impregnation zone, expanding the impregnated tobacco under conditions to provide expanded tobacco also having a high moisture content, and then drying the expanded tobacco following expansion. Drying of the expanded tobacco is preferably conducted within a short time period following expansion, e.g., less than about 5 minutes after expansion. Although a very high moisture content in tobacco fed to a high pressure impregnation zone can cause collapse of the tobacco following expansion in those processes which do not use heating for expansion, it has been found that filling capacity increases are increased with increasing moisture and can be preserved by drying the tobacco to a moisture content of less than about 13 percent following expansion. Advantageously the drying treatment is conducted at a temperature of 350° F. or less and does not reduce tobacco moisture content to less than about 6–8 wt. percent so that the tobacco is not stripped of volatile flavors.

Advantageously, the moisture content of the tobacco fed to the impregnation zone is greater than about 20 wt. percent, and preferably is greater than about 24 wt. percent, in order to provide a substantial increase in the degree of tobacco expansion. Preferably, the high moisture content tobacco is preheated to a temperature greater than about 150° F. prior to impregnation. Drying following expansion of the tobacco in accordance with the invention preserves the high filling capacity level of the expanded tobacco.

In another aspect of the invention, rapid feeding and pre-sizing of tobacco batches for tobacco impregnation and subsequent expansion is achieved. Apparatus provided according to this aspect of the invention includes a substantially vertically oriented metering tube for forming a vertical column of tobacco. A tobacco column dividing means, which is preferably a member having a plurality of tines, is associated with the metering tube and is selectively engageable with the tobacco column for dividing the column into an upper portion above and supported by the dividing means, and a lower portion below the dividing means. A blocking member spaced below the dividing means is engageable with the tobacco column for support of the tobacco column when the dividing means is out of engagement with the column. The blocking member is disengageable with the column of tobacco so that when the dividing means is engaged with the tobacco column, disengagement of the blocking member results in release of the lower portion of the tobacco column from the metering tube. This tobacco is then fed as a batch to the impregnation zone. The size of the tobacco batch can be readily controlled by varying the spacing between the dividing means and the blocking member.

In yet another aspect of the invention, the vertically oriented metering tube is used for preheating of tobacco fed to the impregnation zone. In accordance with this aspect of the invention, steam is injected into the metering tube at a location below the top the tobacco column for heating of the tobacco to a high temperature, preferably between about 100° F. and about 212° F., and the heated tobacco is then delivered to the impregnation zone. Preferably the rapid feeding and pre-sizing system of the invention discussed above is used for feeding the preheated tobacco as a batch to the impregnation zone. Preheating of the tobacco in accordance with this aspect of the invention is rapid because the steam is quickly distributed through the tobacco. In addition, the tobacco above the steam injection zone is preheated by the rising steam and also functions as an insulator for the tobacco in the steam injection zone, so that heating costs can be minimized.

Advantageously, the vertically oriented metering tube is positioned above an opening in an upper wall of a horizontally oriented delivery conduit arranged for delivery of the tobacco batches to the high pressure impregnation apparatus. A reciprocating compressing member is mounted in the conduit for moving the tobacco through the conduit and compressing the tobacco into the high pressure treating apparatus at the downstream end of the conduit. The opening in the conduit communicating with the metering tube is provided with a pivoting closure member capable of compressing the tobacco into the conduit. This allows tobaccos of different densities and batch volumes to be fed into the impregnation zone without requiring replacement or modification of the feeding apparatus.

The invention also provides improvements to the spool and shell apparatus of U.S. Pat. No. 4,554,932 to Conrad and White, to impart improved durability and speed thereto. When used in preferred embodiments of this invention, the spool and shell apparatus is operated at a cycle rate of four to five times per minute or faster. Thus the high pressure spool and shell apparatus is preferably cycled through 3,000 to 3,600 cycles or more in a 12 hour day. Although this apparatus improves speed and economics of tobacco expansion, it has been found that repetitive outward expansion of the elastomeric sealing rings on the cylindrical end members of the spool under high temperature and high pressure conditions can cause premature failure of the sealing rings.

The operation and lifetime of the sealing rings is improved in accordance with the invention by decreasing the radial gap between the spool member and the inside surface of the tubular shell at one or more locations axially adjacent the elastomeric sealing rings. This is advantageously accomplished by providing at least one circumferentially enlarged wear ring on each cylindrical end member of the spool at a position that is axially adjacent and in contact with at least a portion of an axial end face of the elastomeric sealing ring. Preferably the enlarged wear rings are positioned in contact with both axial end faces of each elastomeric sealing ring. Because the wear rings have a greater circumference than the circumference of the end members of the spool in order to prevent the spool from scraping the shell, the axial gap between the spool and the shell is decreased adjacent the wear members. Positioning of the elastomeric sealing rings adjacent the wear rings provides improved axial support to the sealing rings when these rings are forced radially outwardly under great pressures. This, in turn, minimizes destructive axial deformation of peripheral portions of the sealing rings.

In accordance with another aspect of the invention, efficiency of the spool and shell impregnating apparatus is improved by enhancing the rate of delivery and removal of high pressure, gaseous expansion agent, to and from the annular high pressure impregnation zone within the shell. This is accomplished by enlarging the total cross-sectional area of the gas delivery and removal ports communicating between the exterior and interior of the shell while also incorporating a particle blocking means to minimize entry of tobacco into the ports.

In one embodiment of this aspect of the invention, the high pressure gasses are admitted into and removed from the cylindrical shell via a plurality of cooperating ports through the shell that are circumferentially distributed around the cylindrical shell. An exterior manifold member surrounds the ports to contain the processing fluid admitted into the shell through the peripheral ports. The diameter of each port at the interior of the shell is less than a predetermined size in order to prevent tobacco entry into the ports.

In an alternative embodiment, at least one enlarged port having a diameter substantially greater than tobacco particles is provided through the shell. An elongate blocking member having an exterior face of greater width than the port diameter connects longitudinally between peripheral portions of the end members of the spool and is aligned radially with the port opening. When the chamber portion of the spool, i.e., the portion between the end members, is moved through the shell, the blocking member covers the port so that tobacco in the spool chamber is prevented from entering the enlarged port. Preferably, at least two enlarged ports are provided through the shell and a corresponding number of blocking members are provided on the spool.

In yet another aspect, the invention provides improved high pressure accumulators for generating and storing batches of high temperature, high pressure gaseous expansion agent, preferably propane at a temperature above about 250° F. and a pressure above about 2,500 psig. Previously, the supply of batches of high pressure and high temperature propane to the impregnation zone at a cycle rate of four to five times per minute or faster has required either storage of a very large volume of high pressure, high temperature propane; or the use of an accumulator in the form of a pressure vessel having chambers separated by a movable member. An inert pressurizing gas was maintained in one chamber and propane stored in the other. As propane was periodically added to and removed from the vessel, the movable member moved within the vessel, but was subject to failure.

Accumulators according to the present invention employ a high pressure vessel containing both the expansion agent and a gaseous pressurizing fluid within the vessel but with no separating member between the expansion agent and pressurizing fluid. In one embodiment, the vessel is maintained at a temperature above the critical temperature of each of the pressurizing fluid and expansion agent and under a sufficiently high pressure that the pressurizing agent and expansion agent have a high density, near that of liquid. The pressurizing fluid is selected to have diffusivity properties relative to the expansion agent such that the two fluids can be maintained in contact with only extremely low levels of mass transfer due to diffusion occurring between the fluids under the conditions within the vessel. Preferably the pressurizing gas is nitrogen and the expansion agent is propane. At pressures above 2,500 psig and temperatures above about 200° F., these two gasses can be maintained in a vessel substantially separate from each other so that propane can be cyclically added to and removed from the vessel with very low loss of nitrogen to propane.

In another accumulator embodiment, the expansion agent and a gaseous pressurizing fluid are maintained within a high pressure vessel which includes first and second zones arranged for separately maintaining the two fluids under temperature and pressure conditions approaching or above supercritical, and a third zone in fluid communication with each of the first and second zones for maintaining a barrier fluid between the fluids in the first and second zones. The barrier fluid, which can be water, prevents substantial mass transfer between the pressurizing fluid and the expansion agent.

BRIEF DESCRIPTION OF THE DRAWINGS

In the drawings which form a portion of the original disclosure of the invention:

FIG. 8 is cross-sectional view of one end portion of the spool and shell apparatus of FIG. 1 illustrating sealing and wear rings associated with the end members of the spool, and also illustrates a plurality of circumferentially distributed ports through the wall of the shell for introducing a processing fluid into the impregnation zone;

FIG. 8A is a greatly enlarged cross-sectional view of a portion of the apparatus shown in FIG. 8 and illustrates a preferred cross-section for the individual ports through the wall of the shell;

FIG. 9 is a schematic cross-sectional view of a tobacco drying loop employed downstream of the impregnation apparatus of FIG. 1;

DETAILED DESCRIPTION OF THE PREFERRED EMBODIMENT

Figures 1, 1A:
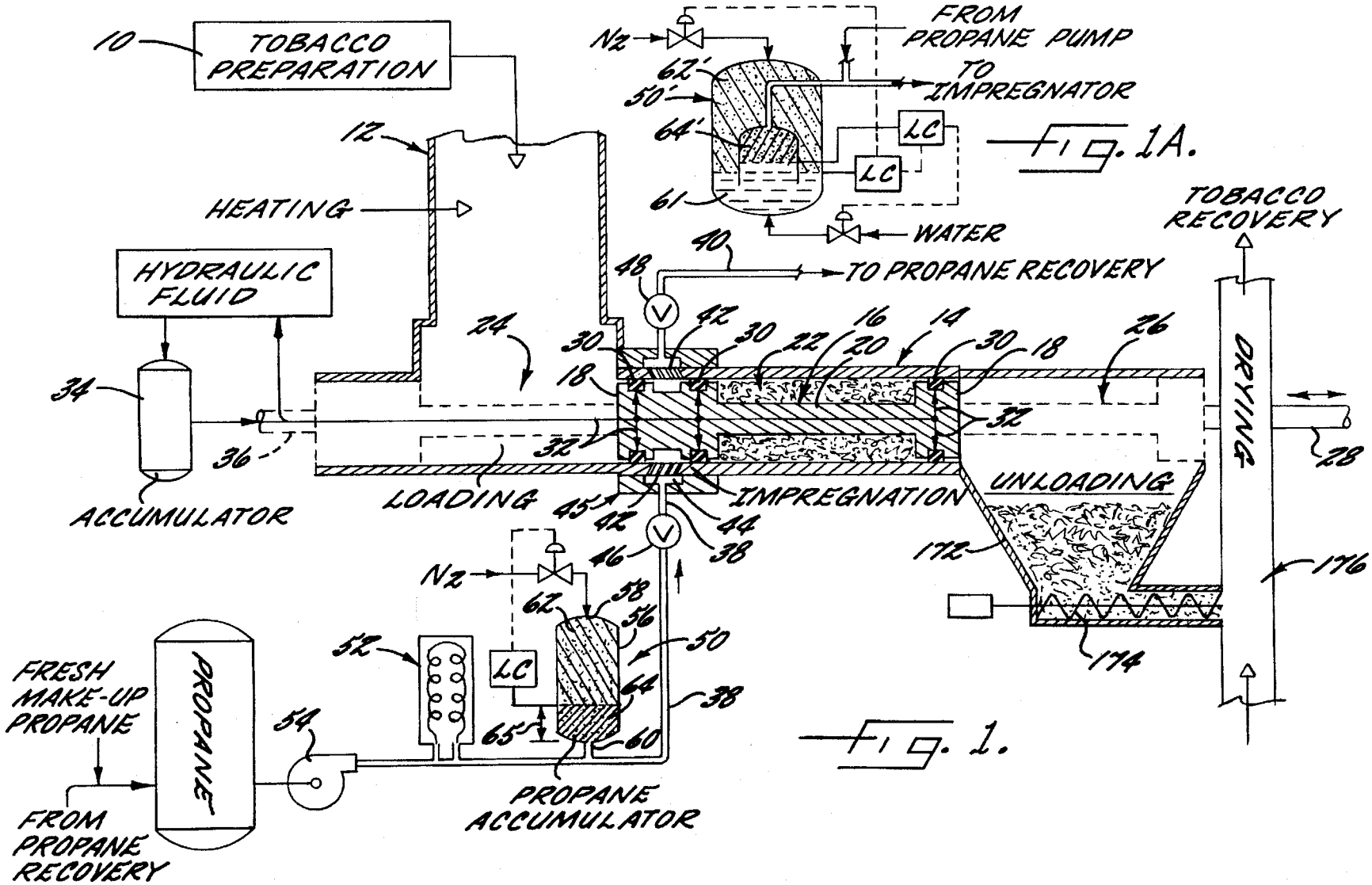
FIG. 1 is a schematic cross-sectional view of one preferred impregnation apparatus employed in the invention with various different operating positions being partially illustrated in phantom.
FIG. 1A is a schematic cross-sectional view of an accumulator which can advantageously be used with the apparatus of FIG. 1 for rapidly supplying high temperature, high pressure impregnating agent thereto, and which includes first and second zones arranged for separately maintaining two fluids under temperature and pressure conditions approaching or above supercritical, and a zone in fluid communication with each of the first and second zones for maintaining a barrier fluid between the fluids in the first and second zones.

Different process and apparatus embodiments of the invention are set forth below. While the invention is described with reference to specific processes and apparatus including those illustrated in the drawings, it will be understood that the invention is not intended to be so limited. To the contrary, the invention includes numerous alternatives, modifications and equivalents as will become apparent from a consideration the foregoing discussion and the following detailed description.

FIG. 1 schematically illustrates preferred impregnation processes and apparatus of the invention including a spool and shell apparatus generally constructed in accordance with U.S. Pat. No. 4,554,932, issued Nov. 26, 1985 to Conrad and White; and pending U.S. patent application Ser. No. 08/076,535 of Conrad and White, filed Jun. 14, 1993, the entire disclosures of both which are hereby incorporated by reference. Various details disclosed in the '932 patent are not repeated herein for the sake of brevity. However, reference may be had to the '932 patent for such details.

As illustrated schematically in FIG. 1, tobacco is preferably first treated in a preparation zone 10 to increase its moisture content to a value above about 16 percent by weight, preferably above about 20 percent by weight. The tobacco of increased moisture content is then passed to a feeding zone 12 wherein the tobacco is heated as described in greater detail below and is then fed to a reciprocating spool and shell high pressure fluid treating apparatus.

The spool and shell high pressure fluid treating apparatus includes a pressure vessel defined by a cylindrical shell or enclosure 14 and a spool assembly 16. The shell 14 and spool assembly 16 can be made of any suitable materials, including stainless steel, and the like. The specific construction and size of the shell and spool will be sufficient to withstand the pressures contemplated within the pressure vessel as will be apparent.

The spool assembly 16 includes cylindrically shaped end members 18 and a connecting rod 20. When the spool 16 is within the shell 14 as illustrated in FIG. 1, the end members 18, together with the connecting rod 20 and the shell 14 define an annular space 22 of predetermined volume constituting a sealed pressure chamber or zone. The spool assembly 16 is positioned horizontally and is arranged for reciprocating movement among a loading position 24, illustrated in phantom; an unloading position 26, also illustrated in phantom; and an impregnating position specifically shown in FIG. 1. A fast acting hydraulic piston or similar motor means (not shown) is axially attached via a shaft 28 partially shown in FIG. 1 for moving the spool among the three positions.

The spool is loaded with tobacco at position 24 as discussed in greater detail later and is then moved to the impregnating position. In the impregnating position, the spool is sealed within the shell 14 by radial expansion of elastomeric sealing rings 30 which are carried in annular grooves formed in each of the spool end members 18. The construction of the elastomeric sealing rings 30 is discussed in detail later in connection with FIG. 8.

The sealing rings are formed of deformable elastomeric material such as vulcanized rubber and are arranged to receive a hydraulic fluid via fluid lines 32. Hydraulic fluid, such as food grade oil, is forced through the lines 32 by a hydraulic accumulator 34. The hydraulic fluid is forced into one end of the spool via a bore through a connecting rod 36, partially illustrated in FIG. 1, connected to at least one end of the spool 16. The hydraulic fluid is forced against the interior of the sealing rings 30 causing them to expand outwardly and seal the pressure chamber 22 against leaks.

Figure 10:
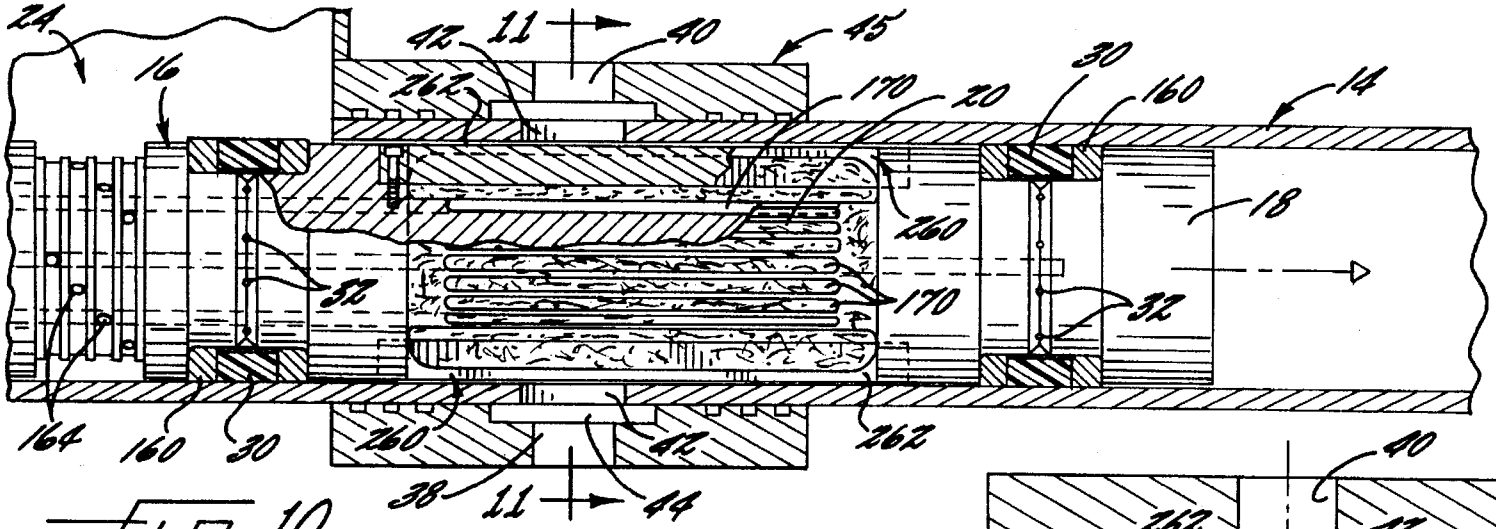
FIG. 10 illustrates a partial cross-sectional view of an alternative fluid introducing arrangement for the spool and shell apparatus of FIG. 1, the spool being shown in motion between its loading position and its impregnating position, in which enlarged ports are provided through the shell, and port blocking members are positioned on the spool in radial alignment with the enlarged ports.
Figure 11:
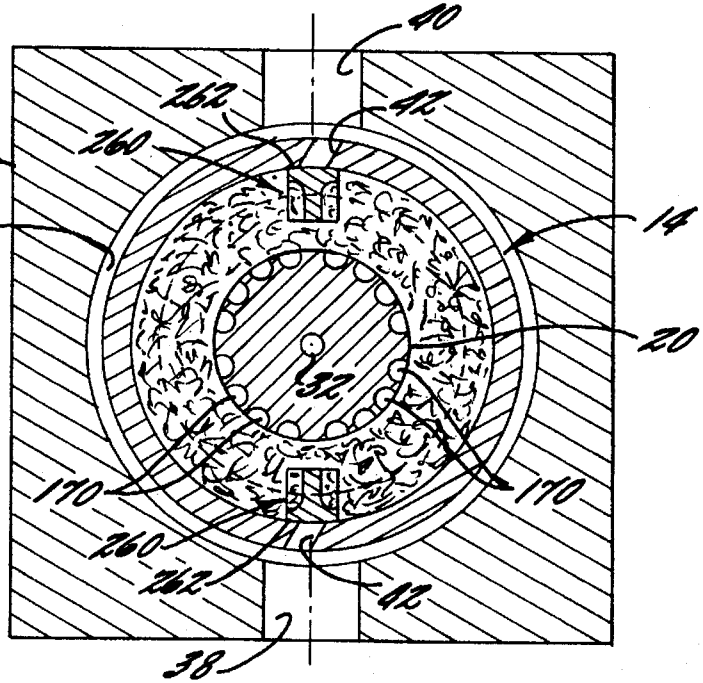
FIG. 11 is a cross-sectional view taken along line 11—11 of FIG. 10 and illustrates how the port blocking members, on the spool, block the ports through the shell as the spool moves through the shell.
Figure 12:
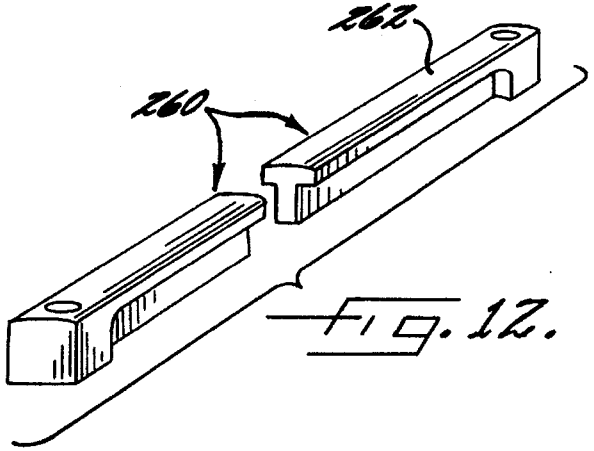
FIG. 12 is an enlarged perspective view of one elongate blocking member disassembled from the apparatus of FIGS. 10 and 11.

High pressure gas supply and exhaust lines 38 and 40, respectively, communicate through the shell 14 via a plurality of ports 42 discussed in detail later in connection with FIG. 8. These ports which may be circumferentially distributed about the periphery of the shell 14 as shown in FIG. 8, or of enlarged cross-section as shown in FIGS. 10, 11 and 12, allow the introduction and removal of high pressure fluid into and out of the pressure chamber 22 when the spool member 16 is in the impregnation position. An exterior manifold 44 surrounds the ports 42 and contains the processing fluid admitted to the shell 14 via the circumferential ports 42. The high pressure fluid flows through the ports 42 and then into the tobacco loaded and compressed about the spool connecting rod 20 via a plurality of ports and channels in the spool body shown in FIG. 8 and discussed later.

A pair of fast acting valves 46 and 48 are provided for rapid introduction and release of fluid into and out of the impregnating chamber 22. These valves are preferably ball valves having a port size ranging from 0.5 inch to 1.5 inch in diameter or greater depending on the size of the impregnation zone 22 to thereby provide for substantially instantaneous admittance and removal of high pressure fluid to and from the impregnation zone 22. The valves are advantageously automatically opened and closed by fast acting hydraulic actuators, not shown.

On the input side, the high pressure gas line 38 is connected to an accumulator device 50 discussed in greater detail below. A heater 52 is provided for heating gas fed to the accumulator 50. Accumulator 50 may also be heated by means not shown to maintain the fluid within the accumulator in heated condition. A high pressure pump 54 is provided upstream of heater 52 for feeding high pressure fluid at, e.g., 2,500 psig, to heater 52 and accumulator 50. Line 40, which is used to remove high pressure fluid from impregnation zone 22, is connected to an optional gas recovery zone (not shown) for recovery of fluid removed from the impregnation zone.

The accumulator 50 is used to provide a high pressure impregnation fluid, such as propane at 2,500 psig, to the impregnation zone in the spool impregnator shown in FIG. 1. The accumulator 50 includes a tubular vessel 56 formed of a material capable of withstanding high temperatures and pressures. At the top and bottom of the accumulator there are ports 58 and 60, respectively, for admitting high pressure gasses.

An inert high pressure gas, such as nitrogen at a pressure of above about 2,500 psig, is admitted through port 58 and, as a result of pressure and temperature conditions in the vessel, is maintained substantially separately in the upper portion 62 while expansion fluid, such as propane, is admitted through port 60 and is maintained at elevated pressure , e.g., above about 2,500 psig, in a lower portion 64 of the vessel. The vessel 56 is maintained at a temperature and pressure approaching or above the critical temperature and pressure of both the pressurizing fluid and the expansion agent. Under these conditions, and with selected fluids such as nitrogen as pressurizing fluid and propane as expansion agent, the diffusivity of the gasses in the two fluid zones 62 and 64, with respect to each other, can be sufficiently low that the two fluids are maintained substantially separately in the accumulator 50.

When expansion agent gas is discharged from the accumulator, the pressure loss is sensed by sensor means (not shown) and a control activates the pump 54 which immediately starts refilling the accumulator with high pressure expansion agent, preferably propane. The pressure sensor can be provided in the accumulator or integrally within the pump 54. The gas accumulator 50 is refilled in a short period of 5–30 seconds, during the period employed in the present invention for impregnating the tobacco in impregnation zone 22 of FIG. 1.

As indicated by arrows 65 in FIG. 1, the level of expansion agent within the accumulator 50 changes cyclicly between a predetermined upper level and a predetermined lower level as it is added to and discharged from the vessel. The lower level is selected to be a certain predetermined distance from the bottom of the vessel, so that discharge of expansion agent does not discharge pressurizing fluid. Also the lower level is chosen to prevent expansion agent near the interface of the two fluids from discharging. For propane and nitrogen gasses, the lower level for the propane fluid can advantageously chosen to be about one foot although different levels can be used depending on the size of the vessel and the conditions therein as will be apparent.

A level control device, LC, can be employed to assist in maintaining the expansion agent, e.g., propane, level within the predetermined limits discussed above. Preferably a fluid interface level sensor or the like is employed to sense the position of the interface between the expansion agent and the pressurizing fluid. An integral or separate control system responds to the level sensor and controls admission and removal of pressurizing fluid, e.g., nitrogen, into and out of the accumulator as required to maintain the maintain the expansion agent between the upper and lower predetermined levels.

Following discharge of expansion agent, a fresh charge of expansion agent is pumped back into the accumulator until a predetermined upper pressure is reached. The predetermined upper pressure is chosen based on: (1) the total combined volume of the accumulator vessel, the impregnation zone 22 and the lines 38 between the accumulator 50 and the impregnation zone 22; and (2) the desired pressure in the impregnation zone. Since the pressure in the accumulator drops as gas is discharged into gas lines 38 and then into the impregnation zone 22 of impregnator as a result of the increase in volume of the gas, the upper pressure must be sufficient that the final pressure of the expansion agent gas reaching the impregnation zone is at the predetermined pressure for tobacco impregnation. Thus where the final pressure is about 2,500 psig, the upper pressure can be, for example, 2,700–3000 psig, depending on the above factors.

Typically there is some loss of the pressurizing fluid over time resulting from absorption of pressurizing fluid by the expansion agent during its contact with the pressurizing fluid while present in the accumulator. Although a low gas diffusivity relationship between the fluids in the accumulator can theoretically allow them to be maintained substantially separately, even extremely low gas diffusivity values for the two fluids in the accumulator can result in a discharge of a small amount of pressurizing fluid with each discharge of expansion agent due to some mixing of the two fluids. However a small level of absorption of pressurizing fluid generally has no substantial negative impact on tobacco expansion.

When the system includes a recovery system for expansion agent recycling, the recovery of the expansion agent following its use will typically result in the separation and removal of any absorbed pressurizing fluid so that substantially pure expansion agent can be recovered for recycling. However the absorbed pressurizing fluid is typically not recovered, and in addition, the presence of absorbed pressurizing fluid in the expansion agent typically decreases the amount of expansion agent which can be economically recovered after use. The amount of pressurizing fluid absorbed by the expansion agent is an equilibrium amount determined based upon the diffusivity values of the two fluids at the temperature and pressure of the accumulator 50, and the turbulence within the accumulator, and is preferably less than about 5 wt. percent.

An accumulator adapted for minimizing absorption of pressurizing fluid by the expansion agent is illustrated in FIG. 1A. This accumulator 50' employs a third and more dense fluid such as water, in a zone separating the pressurizing fluid and the expansion agent, as a movable liquid barrier between the two fluids. As seen in FIG. 1A, the accumulator 50' includes a first zone 62' for receiving a pressurizing fluid such as nitrogen, and a second zone 64' for receiving and separately maintaining the expansion agent under high temperature and pressure conditions. A third zone 61 is in fluid communication with each of the first and second zones and maintains a dense fluid media, such as water, as a barrier fluid between the fluids in the first and second zones.

The barrier fluid shown in the accumulator of FIG. 1A minimizes or eliminates commingling of the pressurizing fluid and the expansion agent even under conditions of increased turbulence. This feature reduces the consumption of the pressurizing fluid and subsequent loss of expansion agent during its recovery, and can also simplify the design of an expansion agent recovery system because separation of absorbed fluid is no longer a substantial consideration. In the accumulator of FIG. 1A, the expansion agent such as propane, will typically absorb a small amount of the barrier fluid, e.g., water.

Both water and nitrogen make-up are supplied to the accumulator 50' and, as shown in FIG. 1A, and separate interface level detectors LC are preferably provided in combination with integral or separate control means for control of water and nitrogen admitted into the accumulator. These controls are responsive to the level detectors and provide for the addition of water in an amount and at a rate sufficient to maintain the total volume of water in the accumulator within predetermined upper and lower control limits. Additionally the control means provides for the addition and removal of nitrogen in response to level detector signals to maintain the height or location of the water-nitrogen interface within predetermined control limits.

In the accumulator apparatus of FIG. 1A, the third zone 64' which maintains the expansion agent substantially separate, is defined in part by a partially closed cylinderical chamber located within an upper portion of the larger pressure vessel. This or a similar arrangement is particularly advantageous in the preferred system employing a barrier fluid that is more dense than either of the pressurizing or expansion agent fluids. It will be apparent that this construction and arrangement is only a preferred construction and that other vessel designs can readily be provided for providing a movable barrier fluid separating the other fluids within the vessel.

FIGS. 1 and 1A illustrate preferred accumulators of the invention. However, other devices for providing the substantially immediate delivery of high pressure, high temperature expansion agent can also be used. For example, a vessel containing only high density expansion agent maintained above supercritical temperature can also be used. When the vessel contains a relatively large mass of expansion agent compared to the mass of expansion agent removed in each cycle and maintains the expansion agent at a high density, the discharge of the expansion agent from the vessel can be accomplished with only a relatively small pressure drop in the expansion agent.

For example, at 2750 psig, and 300° F., the density of propane is 23.76 lb/cu.ft. At the same temperature and a pressure of 2,500 psig, the density of propane is 22.8 lb/cu.ft. Thus a one cubic foot vessel of propane fluid maintained at 2,750 psig and 300° F. can discharge 0.96 pounds of propane at 300° F. to the impregnation zone with only a small decrease in pressure, i.e., from 2,750 psig to 2,500 psig.

In still another embodiment of the invention a mechanical accumulator can be employed to supply expansion agent. One presently preferred mechanical accumulator contemplated for use herein is a 'Metal Bellows' accumulator available from Parker Bertea Aerospace, Parker Hannfin Corp., Metal Bellows Division, Moorpark, Calif.

Returning to FIG. 1, the pressure of the propane admitted to the impregnation zone 22 is preferably above 2,000 psig, and more preferably between about 2,500 psig and 3,000 psig. In accordance with the present invention, it has been found that extremely short impregnation times, between about 5 and about 15 seconds, can be used to impregnate tobacco when these high pressures are used, while obtaining extremely desirable increases in tobacco filling capacity, for example, in excess of 50 to 100% increase in filling capacity. The temperature of the propane is advantageously maintained above 280° F., preferably between about 300° F. and 400° F., e.g., about 300°–315° F. This provides excess sensible heat for heating the tobacco in the impregnation zone.

Figures 2, 2A:
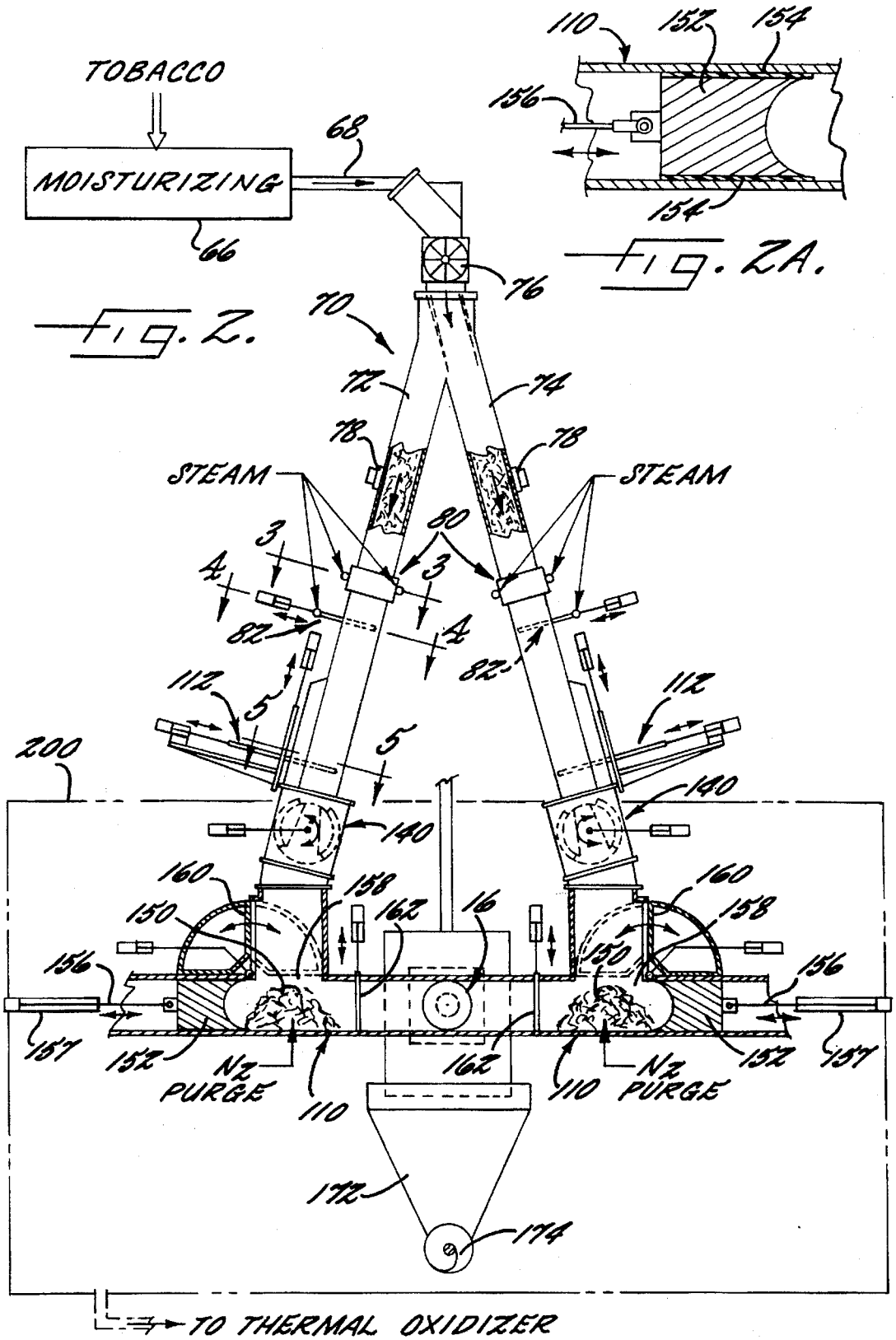
FIG. 2 is a cross-sectional view of one preferred tobacco feeding and loading apparatus including a pair of vertically oriented metering tubes arranged for feeding a pair of horizontally oriented conduits positioned upstream of the impregnation apparatus of FIG. 1.
FIG. 2A is an enlarged cross-sectional view of one end of a reciprocating tobacco compacting member associated with the horizontal conduits in the tobacco loading apparatus of FIG. 2.

Referring now to FIG. 2, a preferred tobacco upstream feeding and loading apparatus is illustrated. Tobacco, in any of various forms including the form of leaf (including stem and veins), strips (leaf with the stem removed), cigar filler, cigarette cut filler (strips cut or shredded for cigarette making), or the like, preferably cut filler tobacco, is moisturized by means known to those skilled in the art in block 66 to a moisture content of at least about 13%, and preferably at least about 20%, and passed through a pneumatic conveying pipe 68 to a metering device designated generally as 70. Advantageously, as illustrated, the metering device 70 is formed by two separate metering tubes 72 and 74. Preferably each of the metering tubes 72 and 74 has a substantially rectangular cross-section that increases or diverges slightly in size in the direction of tobacco flow. As will be apparent, the metering tubes can have other configurations, such as a circular cross-section.

The tobacco from pipe 68 enters a feed valve 76 located at the top of the metering tubes and is distributed between the two metering tubes 72 and 74. Any of the valves known in the art for feeding a solid material such as tobacco into a column can be used in accordance with the present invention. An exemplary feed valve is a multi-vaned rotary valve as illustrated in FIG. 2. The thus distributed tobacco forms a substantially vertical tobacco column in each of the metering tubes 72 and 74. These vertical tobacco columns are of a predetermined height, which is monitored in each of the metering tubes by height sensing means 78. Preferably, the height of the tobacco column in each of the columns is about three to four feet. When the height of the tobacco falls below the predetermined desired height in either of the tubes, the sensing means actuates the feed valve so that additional tobacco enters the tube until the desired height is obtained.

After the tobacco is distributed and fed into each of the metering tubes 72 and 74, it is subjected to a steam preheating treatment, which also further moistens the tobacco. Preheating of the tobacco provides heat for establishing proper short cycle time conditions in the impregnation zone. Additionally, extra moisture added to the tobacco plays a role in providing good expansion results and increases the pliability of the tobacco. In accordance with this invention, it has been found that when the tobacco fed to the impregnation zone 22 has a moisture content above about 20 wt. percent, preferably between about 24 wt. percent and about 30 wt. percent, and is preheated to a temperature above about 150° F., increased expansion can be obtained. In the present invention, the tobacco is preferably both moisturized and preheated by steam injection into each of the stems of the metering column. Steam heating is desirable because heat can be effectively and efficiently transferred to the tobacco, while at the same time the moisture level can be increased. In addition, because the tobacco is contacted with steam in a metering tube, the tobacco in the tube above the steam injection zone or zones can act as an insulator thus increasing the efficiencies of using stem injection to heat the tobacco.

Steam is injected into each of the metering tubes 72 and 74 at a location below the top of the tobacco column in the tube. Two preferred steam injectors are designated generally as 80 and 82 in FIG. 2 and each are described in greater detail below. These injectors require dry steam which can be provided by superheat or by external heating of steam pipes and manifolds to prevent condensation. In addition, the temperature of the steam injected is sufficient to heat the tobacco to a temperature above ambient temperature, preferably above about 125° F., more preferably a temperature of above 150° F., e.g., to a temperature of 150° to about 200° F.

Figure 3:
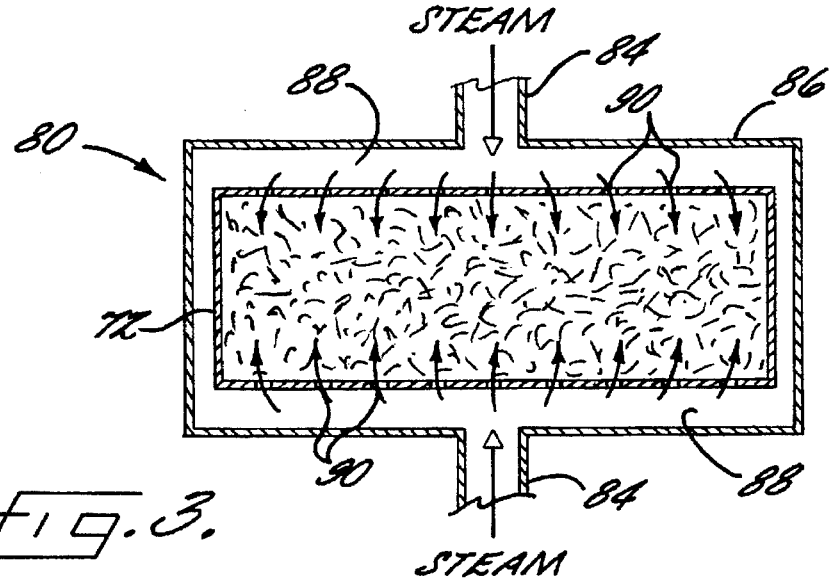
FIG. 3 is an enlarged cross-sectional view taken along line 3—3 of FIG. 2 and illustrates one preferred embodiment of a steam injecting apparatus associated with the metering tubes in the apparatus of FIG. 2 for introducing steam into a tobacco column.
Figure 4:
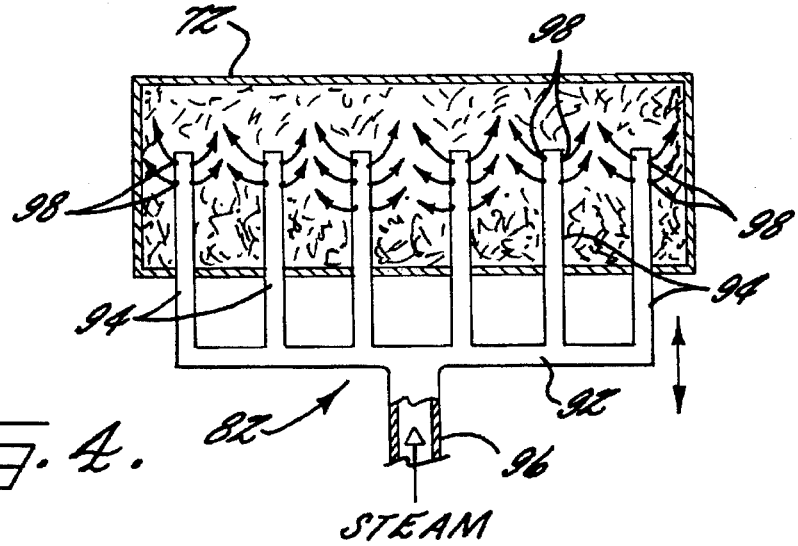
FIG. 4 is an enlarged cross-sectional view taken along line 4—4 of FIG. 2 and illustrates a different advantageous embodiment of a steam injecting apparatus associated with the metering tubes in the apparatus of FIG. 2.

FIGS. 3 and 4 illustrate two embodiments for providing steam injection into the tobacco columns. FIG. 3 is a top view taken along line 3—3 of FIG. 2 of steam injector 80. Steam is injected through conduits 84 into an exterior manifold 86 surrounding the metering tube 72. The manifold is spaced apart from the exterior wall of the metering tube to form an annular enclosed space 88. This space contains the injected steam. The manifold 86 communicates with the interior of the metering tube via a plurality of ports 90 distributed along opposing faces of the tube. Steam passing through ports 90 penetrates into the tobacco column an indicated by the arrows in FIG. 3

FIG. 4 illustrates another preferred embodiment of a steam injecting apparatus for introducing steam into the tobacco columns. In FIG. 4, the steam injecting apparatus 82 is an insertable forked member formed by a hollow bridge 92 supporting a plurality of hollow apertured tines 94. The steam injecting member 82 is positioned horizontally for reciprocal movement between a first position outside of the metering tube 72 and a second position within the tube. A hydraulic piston or similar motor means is axially attached via a shaft for moving the steam injector between the two positions so that the tines 94 penetrate into and out of the tobacco column as indicated by the direction arrow in FIG. 4. When the tines are inserted into the tobacco column, steam is injected through a conduit 96 into the bridge and then into each of the tines of the insertable member. Steam then exits from the tines through a plurality of ports 98 in each tine member into the tobacco column as indicated by the arrows.

Although use of both embodiments of the steam injectors is illustrated in FIG. 2, it will be apparent to the skilled artisan that either of the steam injectors may be used alone. It can be advantageous, however, to use a combination of the two steam injectors to insure that the steam is injected across the entire width of the tobacco column.

The steam injectors of the present invention are preferably placed at a selected location along the height of the tobacco column such that substantially all of the steam injected into the column is condensed prior to exiting top of tobacco column. The injected steam travels upwardly within the tobacco column and heats the tobacco within the tobacco column as it rises. As heat is gradually lost from the steam, it condenses onto the tobacco as moisture, until all steam has condensed.

Following preheating and moistening the tobacco travels downwardly in the column for dispensing as a batch to loading conduits 110, shown in FIG. 2. A tobacco column dividing member, designated generally in FIG. 2 as 112, is operatively associated with each of the metering columns 72 and 74. Like the tined steam injectors 82, the tobacco column dividing member is positioned for horizontal reciprocating movement between a first position outside of the column and a second position within the column.

Figure 5:
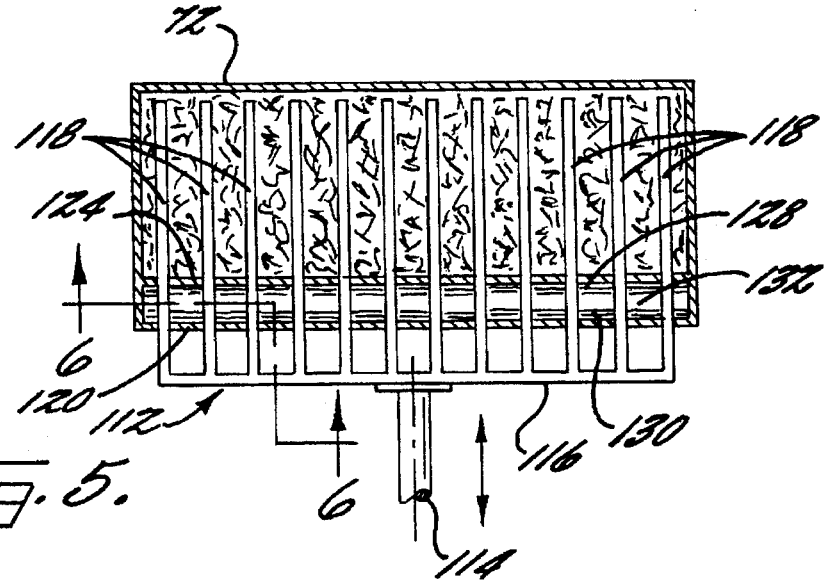
FIG. 5 is an enlarged cross-sectional view taken along line 5—5 of FIG. 2 and illustrates a preferred embodiment of a tobacco column dividing means associated with the metering tubes in the apparatus of FIG. 2.

A top view of a preferred embodiment of the tobacco dividing member is illustrated in FIG. 5. As shown in FIG. 5, tobacco dividing member 112 comprises an actuator rod 114, a bridge 116 and a plurality of closely spaced tines 118. The dividing members move between the first and second positions to divide the tobacco column into upper and lower portions and to thereby measure a predetermined amount of tobacco which is to be dispensed from the bottom of each of the tobacco columns. When the tines 118 are inserted into the tobacco column via an opening described below, the upper portion of the tobacco positioned above the dividing means is supported by the tines. The tines are accordingly closely spaced, e.g., about one-fourth to one and one-half inches apart. The lower portion of the tobacco column below the tines is subsequently dispensed to the loading conduits 110.

Figure 7:
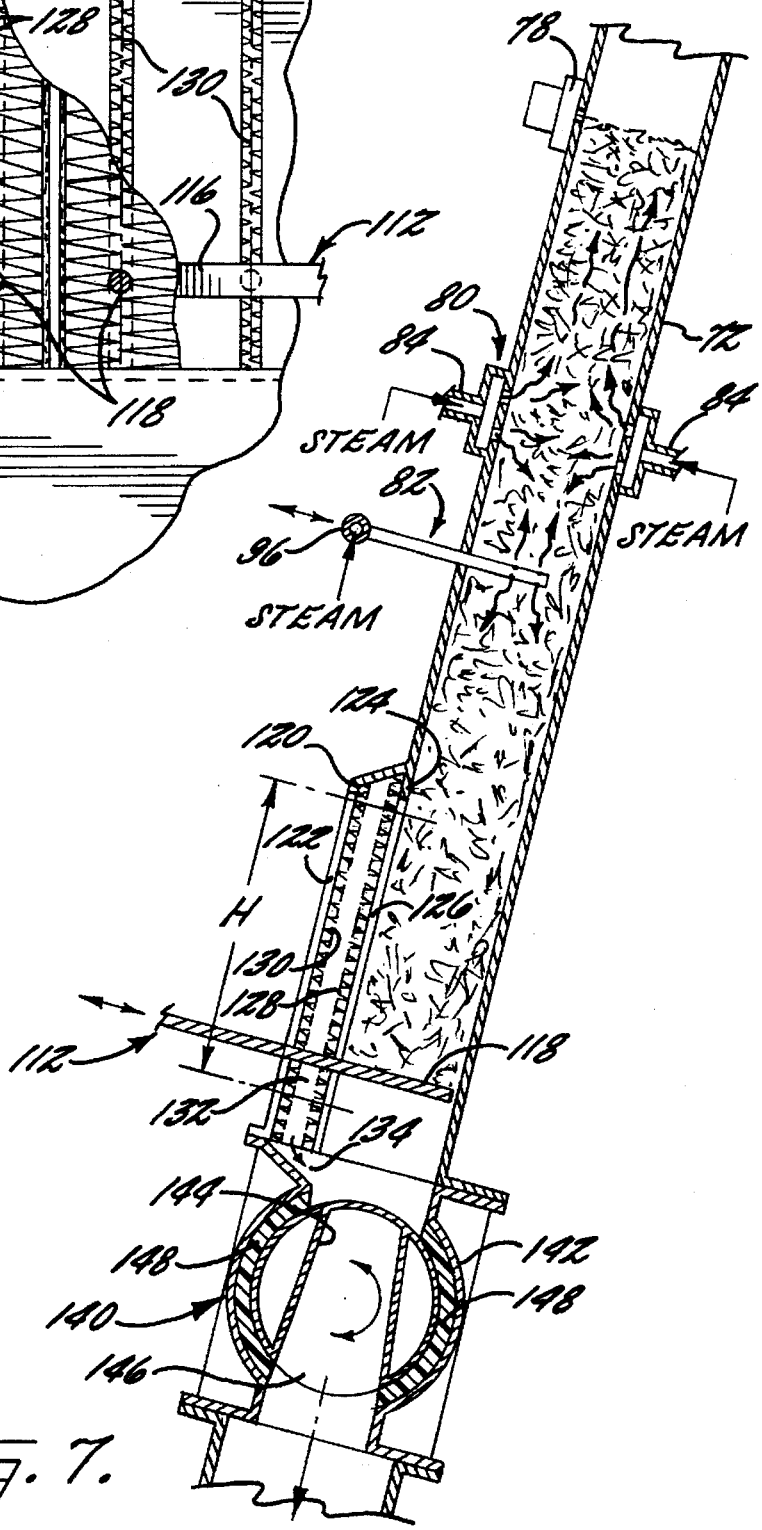
FIG. 7 is an enlarged schematic cross-sectional view of a portion of the feeding apparatus of FIG. 2 illustrating the steam injecting apparatus, the tobacco column dividing means, and a blocking member for delivering a predetermined volume of tobacco to the impregnation expansion apparatus of FIG. 1.

The tined tobacco dividing element 112 is preferably vertically adjustable for selective engagement with the tobacco column in a plurality of predetermined vertical locations. FIG. 7 illustrates a range H of heights through which the position of the tobacco column dividing member can be adjusted. This provides flexibility in selecting the amount of tobacco to be dispensed to the loading conduits 110 because adjusting the position of the dividing member adjusts the size of the tobacco charge dispensed from the bottom of the column.

Figure 6:
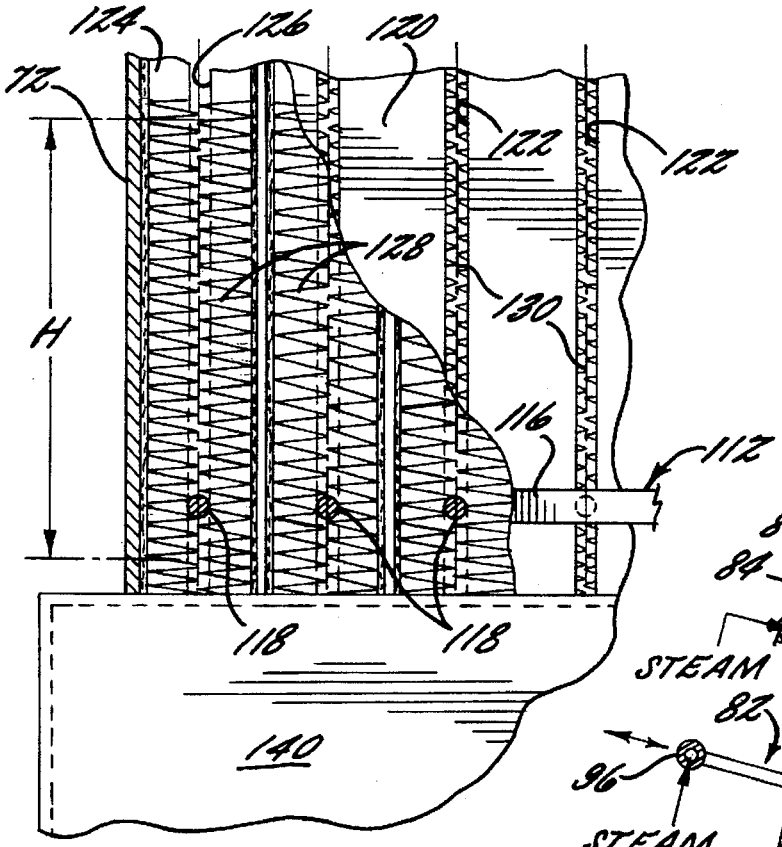
FIG. 6 is partial front view with portions thereof being broken away, taken along line 6—6 of FIG. 5 showing a lower portion of one metering tube of the apparatus of FIG. 2 and illustrates a plurality of brushes associated with the tobacco column dividing means of FIG. 5.

The tines 118 of dividing member 112 access the tobacco column via a plurality of vertical elongate slots, which are aligned with the tines 118 through a double walled portion of the metering tube as best illustrated in FIGS. 6 and 7. FIG. 6 illustrates a first outer side wall 120 having elongated vertical slots 122 formed therein. The outer side wall 120 is partially broken away in FIG. 6 to illustrate a second spaced apart inner side wall 124 which includes a second row of vertical slots 126 aligned with vertical slots 122 and a plurality of horizontal brushes 128 associated therewith. In addition, a plurality of brushes 130 are also advantageously associated with the outer wall 120. The double wall structure acts as a catch basin to receive tobacco particles that can adhere to the tines of the dividing means when the tines are removed from within the tobacco column. The brushes assist in removing tobacco particles from the tines. As the tines are withdrawn from within the tobacco column to a position outside of wall 120, they contact the two rows of brushes and tobacco particles are scraped off of the tines and fall into an opening 132 between the walls. The tobacco particles fall downwardly within the opening 132 to a lower portion thereof and exit the opening through a port 134 at the lower end of the opening.

A blocking member preferably in the form of a rotary valve 140 is associated with the bottom of each metering tube. The blocking member 140 is engageable with the tobacco column at a vertical location below the dividing means 112 for supporting the tobacco column when the dividing means is out of engagement with the column. The blocking member 140 is also disengageable with the tobacco column for releasing the lower portion of the tobacco column below the dividing means 112 to the loading conduits 110.

The blocking member 140 is preferably an air lock rotary valve. The air lock rotary valve may be any of the valves known to the skilled artisan, and advantageously, the valve is an vaneless rotary valve which is intermittently operated for receiving and delivering one batch of tobacco at a time as illustrated in FIG. 7. The vaneless rotary valve of FIG. 7 comprises a housing 142 supporting a bucket or pocket 144 which is rotatable within the housing. A continuous air lock rotary valve, such as that having a plurality of vanes, can also be used.

The blocking member 140 is illustrated in FIG. 7 in an emptied, tobacco column supporting position. When a new a charge of tobacco is to be dispensed from the bottom of the tobacco column, the tined dividing member 112 is inserted into the tobacco column and the blocking member is rotated 180° from its blocking position to its tobacco receiving position so that the open end 146 of the bucket 144 is upwardly positioned in communication with the tobacco column. In this position the bucket receives the tobacco in the lower portion of the column and then is moved again 180° to a position dispensing the presized batch of tobacco to the loading conduits 110. The use of an air lock rotary valve as a blocking member is particularly desirable because in its dispensing position (shown in FIG. 7), the valve blocks and supports the tobacco column and also provides a seal 148 between the tobacco column and expansion agent impregnation zone.

The batch dispensing system of the invention provides a number of benefits. The amount of tobacco dispensed to the impregnation zone can be easily and accurately controlled. Thus the dividing members can be vertically positioned at various positions to provide any of various predetermined sized batches of tobacco for impregnation. In addition, the use of metering tubes provides substantially even distribution of the tobacco batch across the width of the loading conduit, below. Batch dispensing of the tobacco charge is fast, and can provide each tobacco charge to the impregnation zone in concert with the short impregnation cycles of the present invention.

Referring now back to FIG. 2, the predetermined amount of tobacco is thus dispensed into loading conduits 110 for loading onto the spool of the impregnating apparatus. As illustrated in FIG. 2, separate charges 150 of tobacco are loaded onto the spool at loading position 24 (FIG. 1) by means of a pair of opposed semi-cylindrical loading and compressing members 152 which are mounted for reciprocating movement within horizontal conduits 110. Preferably, loading conduits 110 have a substantially rectangular cross-section and are formed of a material which can withstand wear associated with the repeating horizontal movement of the loading members within the loading chambers, such as hardened aluminum. In addition, advantageously, as illustrated best in FIG. 2A, the upper and lower surfaces of the loading and compressing members are covered with hardened plastic sleeves 154 which provide lubrication between the interior walls of the loading chambers and the exterior surface of the loading members to prevent buckling or jamming of the loading members. Exemplary materials used to form the sleeves include polyetheretherketone (PEEK), available from ICI America and RTP Co.

The loading members 152 are connected via rods 156 to a reciprocating force means such as a hydraulic piston 157 or the like for cyclic movement between a retracted position and an extended position. The tobacco charges are dispensed into the loading conduits 110 through an opening 158 in the upper wall thereof. The opening 158 extends substantially across the width of the loading conduits and is located between the retracted position of loading members 152 and the extended position thereof. A pivoting closure member 160 for closing this opening is also provided and is capable of compressing the tobacco charge into the loading chamber when in a closed position as indicated in phantom in FIG. 2. Advantageously a pair of blocking members 162, which may be tined members, are provided to separate the loading chamber from the impregnation apparatus. The blocking members 162 are mounted for movement between a first disengagement position outside of the loading conduits and a second blocking position within the loading conduits and prevent tobacco from being blown along the conduit as the closure member is closed.

To load the tobacco charges onto the spool 16, the tobacco charges 150 are dispensed from the rotary valve 140 through opening 158 into loading conduits 110. The blocking members are inserted into the conduits 110 and the pivoting closure members 160 are pivoted downwardly to cover the opening 158 and thus compress if necessary and contain the tobacco charge within the loading conduits. The semi-cylindrical loading members 152 are then moved to their extended position. The tobacco charges are moved horizontally through loading conduits by the loading members 152 and compressed onto spool 16. The opposed semi-cylindrically shaped loading members cooperate in their fully extended positions to form a shell around the connecting rod 20 of the spool so that the compressed tobacco is maintained on the connecting rod of the spool during its movement to the impregnating position, discussed below. The cylinderical shell formed by the loading members can also be defined in part by one or a pair of longitudinal frame members (not shown), that can be provided at locations above and/or below the axis of the spool. Such frame members are advantageously adapted to mate with the edges of the semicylinderical loading members to form a closed cylinderical space around the compressed tobacco.

The loaded spool is moved into its impregnation position as shown in FIGS. 1 and 8, and the sealing rings 30 on both ends of the spool are forced radially outwardly by hydraulic fluid from fluid lines 32 for sealing the pressure chamber 22 against leaks. Advantageously, the sealing rings are vulcanized or otherwise bonded into annular grooves formed in the periphery of the spool ends. A deformable plate or tape 153 is provided at the interface between each of the elastomeric sealing rings and the fluid lines 32 so that the sealing rings are not bonded at this point and can thus be forced outwardly.

Annular members 160 which may be wear rings, scraping rings or the like, are also attached in annular grooves formed in the periphery of each of the cylindrical end members of the spool and are axially adjacent to at least one end face of each of the elastomeric sealing members 30. The wear members have a circumference greater than that of each of the cylindrical end members of the spool, which narrows the annular space or gap between the spool assembly 16 and the shell 14. By narrowing this gap, the elastomer of the elastomeric sealing rings 30 receives better axial support during the time it is used for sealing. This minimizes destructive deformation of the sealing rings resulting from "overflow or extrusion" of the peripheral edges of the sealing rings into the annular space between the cylindrical end members of the spool assembly and the shell.

Preferably, each sealing ring 30 is attached to a face of a wear member 160 and to surface on the periphery of the spool end member. More preferably, wear members 160 are provided axially adjacent both end faces of the elastomeric sealing rings 30 and are attached thereto. The wear members can be attached to the elastomeric sealing members by welding, adhesive bonding, vulcanization processes, and the like.

FIG. 8 also illustrates a preferred port construction allowing high pressure gas lines 38 and 40 to communicate through the shell 14 with rapid delivery of expansion agent. A plurality of ports 42 are circumferentially distributed about the periphery of the shell 14. The enlarged port opening cross-sectional area provided by ports 42, taken as a group, provides for an enhanced rate of introduction and removal of high pressure fluid into and out of the pressure chamber 22 when the spool member 16 is in the impregnation position. Advantageously, ports 42 are diagonally oriented and taper to smaller diameter openings as illustrated in FIGS. 8 and 8A to block entry of particulate tobacco into the ports as the spool assembly moves from position to position.

An exterior manifold 45 surrounds the shell 14 and forms an annular space around the circumferentially distributed ports. The ports 42 are aligned with an annular groove 162 in the spool end which communicates via a plurality of radial channels 164 and axial channels 166 with grooves 170 formed in the surface of connecting rod 20. Once introduced through gas line 38, the high pressure fluid flows through the ports 42 into channels 164 and 166 until reaching grooves 170. Here, the fluid is exposed to the tobacco loaded and compressed about the spool connecting rod 22 and flows out of the channels and into the tobacco as illustrated by the arrows in FIG. 8. One or more screens (not shown) surround the connecting rod 20 to prevent tobacco from clogging the grooves 170.

FIGS. 10, 11 and 12 illustrate an alternative apparatus for improving efficiency of the spool and shell impregnator by enhancing the rate of delivery and removal of high pressure, gaseous expansion agent, to and from the annular high pressure impregnation zone within the shell. As illustrated in FIGS. 10 and 12, the apparatus is shown with the spool assembly body 16 in motion between a loading position and an impregnating position. Thus the spool assembly 16 is shown partially within, and partially outside of the shell 14. In this apparatus, each port 42 through shell 14 is advantageously in the form of a slot of enlarged cross-sectional area, that is preferably about the same as the cross-sectional area of the openings through the valves 46 and 48 in the gas lines 38 and 40 that supply and remove expansion agent to and from the impregnator. This allows a reduction in the frictional interaction between the ports and the expansion fluid with a net result of providing a faster feed rate for expansion fluid entering into and leaving the impregnator.

Because the enlarged ports 42 have a diameter greater than the size of tobacco particles, e.g. tobacco cut filler, the apparatus of FIGS. 10–12 includes a port blocking member 260, best seen in FIG. 11, to prevent or minimize entry of tobacco into the enlarged ports. The port blocking member 260 is an elongate body having an exterior face 262 of greater width than the port diameter. As best seen in FIGS. 11 and 12, the blocking member 260 is joined longitudinally between peripheral portions of the end members 18 of the spool assembly 16 and is aligned radially with the port openings 42 through the shell (FIG. 12).

As illustrated in FIG. 11 the blocking members extends across a portion of the connecting rod 20 of the spool 16 which, in turn forms the 'chamber' on the spool for holding tobacco. When this portion of the spool is moved through the shell, the blocking members 260 cover the ports 42 through the shell 14 so that tobacco in the spool chamber is prevented from entering the enlarged ports 42. As best seen in FIGS. 11 and 12, the exterior face 262 of the blocking member 260 is advantageously curved to match the inside surface of the shell 14. The lower portion of the blocking member is advantageously tapered in order to minimize the reduction in space available for occupation by tobacco.

Preferably, at least two enlarged ports are provided through the shell and a corresponding number of blocking members are provided on the spool as seen in the Figures. A manifold 45 is provided around the exterior of the shell 14 and defines an annular space 44 that connects to both of the ports 42 so that expansion agent introduced through the manifold port 38' can communicate with the spool simultaneously through both shell ports 42. Similarly, expansion agent removed through manifold port 40' following use can also exit the shell through both ports 42. This also increases the rate of feed and removal of expansion agent from the spool and shell impregnator allowing a reduction in cycle time.

Returning to FIG. 1, following introduction of expansion agent into the impregnator apparatus, the compressed and impregnated tobacco is maintained under impregnation conditions for a short period of time ranging from 1–2 seconds up to about twenty seconds. Thereafter the pressure is released. Preferably, pressure release is substantially instantaneous, i.e., is achieved in about one second or less. This can be achieved in part by employing a fast acting valve having a large port for rapidly releasing pressure. A sensor not shown is advantageously provided for sensing pressure within the impregnator and triggers deflation of the sealing rings 30 on the spool body when the pressure therein reaches a predetermined pressure above ambient pressure, e.g., 5 psig. A second pressure sensor senses the pressure of the hydraulic fluid in line 36 which feeds the sealing rings. Prior to the time when this pressure reaches ambient, e.g. at 5 psig, this sensor triggers operation of the hydraulic piston connected to shaft 28 for moving the spool body. The spool is then moved to unloading position 26 substantially immediately so that tobacco expansion can be effected.

A pneumatic unloading device such as an oil free compressor (not shown) is provided in the tobacco unloading zone and directs fluid such as high pressure air or nitrogen onto the tobacco surrounding spool 16 when the spool is moved to and from the unloading position 26. The expanded tobacco removed into the unloading position 26 expands substantially instantaneously and as illustrated in FIG. 1, is fed to a recovery chute 172 and then to a conveying apparatus 174, such as a screw conveyor and the like. The tobacco which advantageously contains a substantial amount of moisture, i.e., greater than 13 wt. percent, is conveyed to a drying zone 176 by conveying apparatus 174.

As best shown in FIG. 9 the expanded tobacco is admitted into a conduit 178 in the drying zone where it is picked up by upwardly moving heated air. Advantageously the heated air has a temperature of less than about 350° F., and is preferably at a temperature between about 200° F. and about 300° F. The tobacco is conveyed through the drying zone at a temperature and for a time sufficient to decrease the moisture content thereof to less than about 13 percent, and preferably to a value of between about 6 and about 12 wt. percent. The dried, expanded tobacco is then passed to a separation zone 180. Here the fluids, including the expansion agent, pass through a screen 182 or another separating apparatus such as a cyclone separator and into a recovery loop 184.

The gas moving through the recovery loop is preferably primarily nitrogen or another inert gas, and is injected into the loop as indicated by gas injection zone 186. The nitrogen is heated by a heater 188, passed through a fan 190 and then continues on in the loop for picking up the tobacco. A purge stream 192 is removed continuously from the loop and passed to a thermal oxidation zone wherein the propane in the nitrogen is burned.

The tobacco passes from the separation zone 180 to a pair of rotary air lock valves 194 and 196 and then recovered in a recovery zone 198. The two valves function to insure that no propane gas is passed outwardly into the recovery zone. Therefore, inert gas, such as nitrogen, is admitted between the two valves. Also, as indicated in FIG. 2, nitrogen can be admitted in other areas of the system for similar reasons. In this regard, a safety shell 200 in FIG. 2 can be provided about the lower portion of the apparatus, as indicated in phantom. This shell is provided for the recovery of any propane exiting from the system during use. Nitrogen is continuously added to various places in the system. Propane which exits from various leaks in the system is recovered in the shell and passed to a thermal oxidizer for burning.

Returning to the drying treatment, although when the expansion agent is propane or a similar expansion agent of the type disclosed in U.S. Pat. No. 4,531,529 to the White and Conrad, no heating of the tobacco is necessary in order to fix the tobacco in expanded form, it has now been found that high moisture content tobacco can be expanded to a greater degree than tobacco of normal moisture content. However it has also been found that some or all of the increased expansion can be lost as the high moisture tobacco can collapse. The drying treatment of this invention has been found to preserve the increased expansion.

Preferably the drying treatment is conducted rapidly after expansion of the tobacco, e.g., less than about 5 minutes after expansion, preferably within a time period of less than about 1 minute following expansion. Indeed, drying can be conducted substantially instantaneously following expansion. For example, the blower used to unload expanded tobacco from the spool can employ heated nitrogen if desired and the tobacco can be immediately passed into the drying zone.

Figure 13:
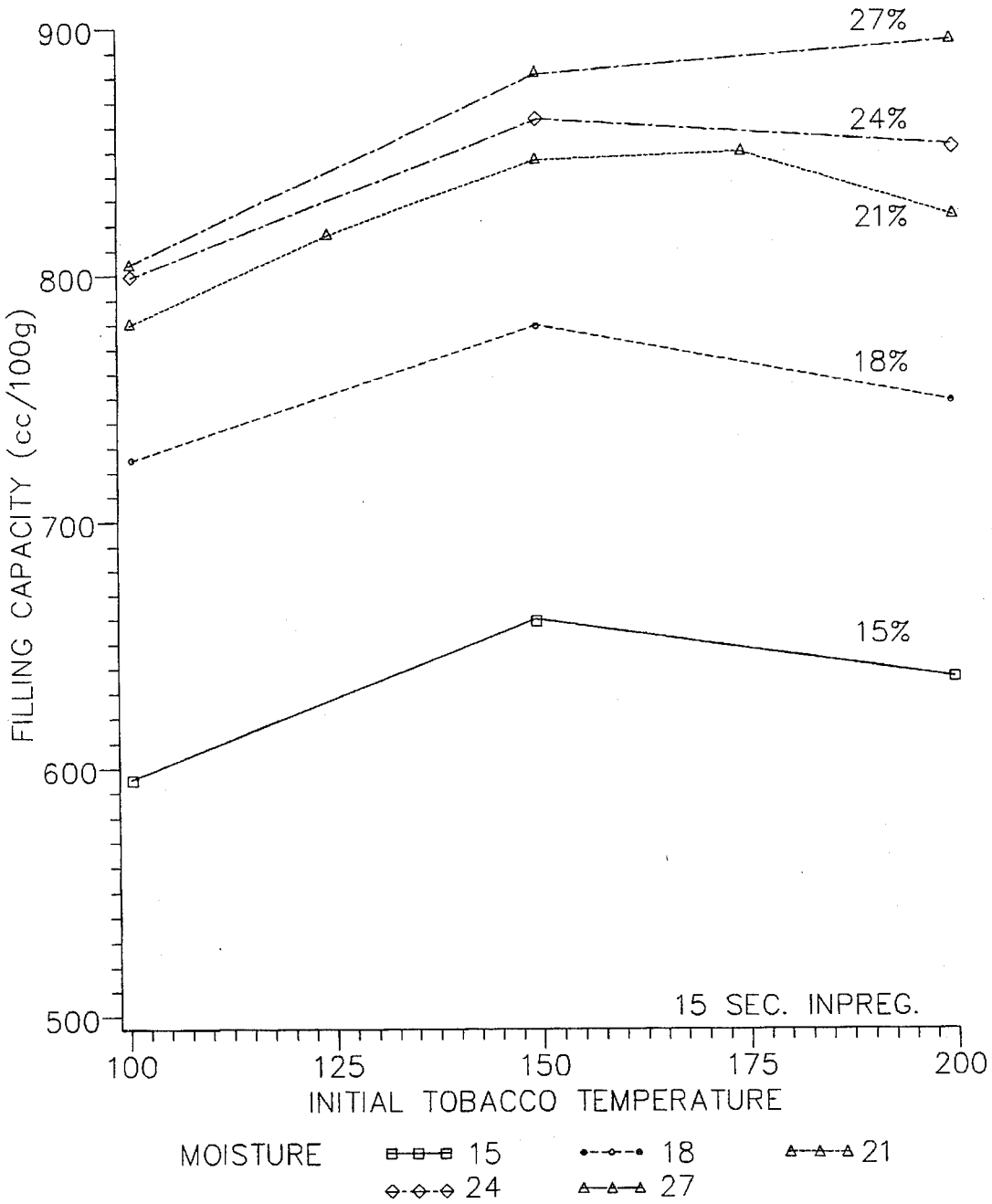
FIG. 13 is a graph illustrating tobacco expansion with varying amounts of moisture and various degrees of tobacco preheating.

The effect of moisture content on tobacco expansion is illustrated with reference to FIG. 13 which is a graph showing tobacco expansion with varying amounts of moisture and various degrees of tobacco preheating. In each case the tobacco was impregnated for 15 seconds with propane at a pressure of about 2,500 psig and which had been preheated to a temperature of about 300° F. Prior to expansion, the tobacco had a filling value of about 450 cu.cm/100 g. As can be seen from FIG. 13, increasing moisture content of the tobacco to a level above about 20 percent greatly improves expansion thereof particularly when the tobacco is preheated to a temperature of about 150° F. or higher.

When propane is used as the impregnating fluid, the cumulative amount of heat supplied to the impregnation zone from the heated propane and the preheated tobacco is advantageously sufficient to provide impregnation conditions in the impregnation zone of between about 240° F. and about 270° F., preferably about 260° F. It has been found that impregnation at temperature and pressure conditions of about 260° F. and 2,500 psig can be achieved in about 5 seconds or even less when the heat is supplied by both the preheated tobacco and preheated propane.

The degree of tobacco compression during impregnation also influences the degree of expansion. Preferably the tobacco is compressed to a compression ratio of at least about 1.5:1 during impregnation. Compression ratio is determined based on the volume of the tobacco prior to compression. The tobacco volume prior to compression, or the loose fill volume of the tobacco, is determined by measuring the tobacco density in a cubic container of one foot by one foot by one foot. Tobacco is poured into the cubic container and weighed to determine the loose fill density of the tobacco. The loose fill volume of a tobacco charge prior to compression onto the spool then can be determined from the weight of the charge and the loose fill density value of the tobacco. The loose fill volume of the charge is divided by the compressed volume of the tobacco charge, i.e., the volume treated in the impregnation apparatus such as the spool, to determine compression ratio. All values are determined at, or corrected to, the actual moisture of the tobacco charge fed to the impregnation zone. Thus, for a spool having an impregnation volume of 25 cubic inches, compressing tobacco having a loose fill volume of 50 cubic inches onto the spool, would result in a compression ratio of 2:1.

Advantageously, the tobacco is compressed to a compression ratio of greater than 2:1, up to ratios amounts of 3:1 and greater. Compression of the tobacco increases the tobacco density so that the density of the tobacco fed into the impregnation zone is substantially greater than the tobacco density prior to compression. Those skilled in the art will be aware that loose fill tobacco densities can vary greatly depending on whether the tobacco is in leaf form or in cut filler form; the type of tobacco, the moisture content of the tobacco, and other factors. Packing densities of 20–35 pounds per cubic foot, calculated based on a moisture content of 12% are readily employed in the present invention. Although increasing the packing density can, to some extent, increase the cycle time for achieving identical amounts of expansion, packing densities in excess of 25–30 pounds per cubic foot calculated based on 12% moisture and higher have also been successfully used in the present invention while achieving impregnation times of below 20 seconds and filling capacity increases in excess of 50–100%.

Figure 14:
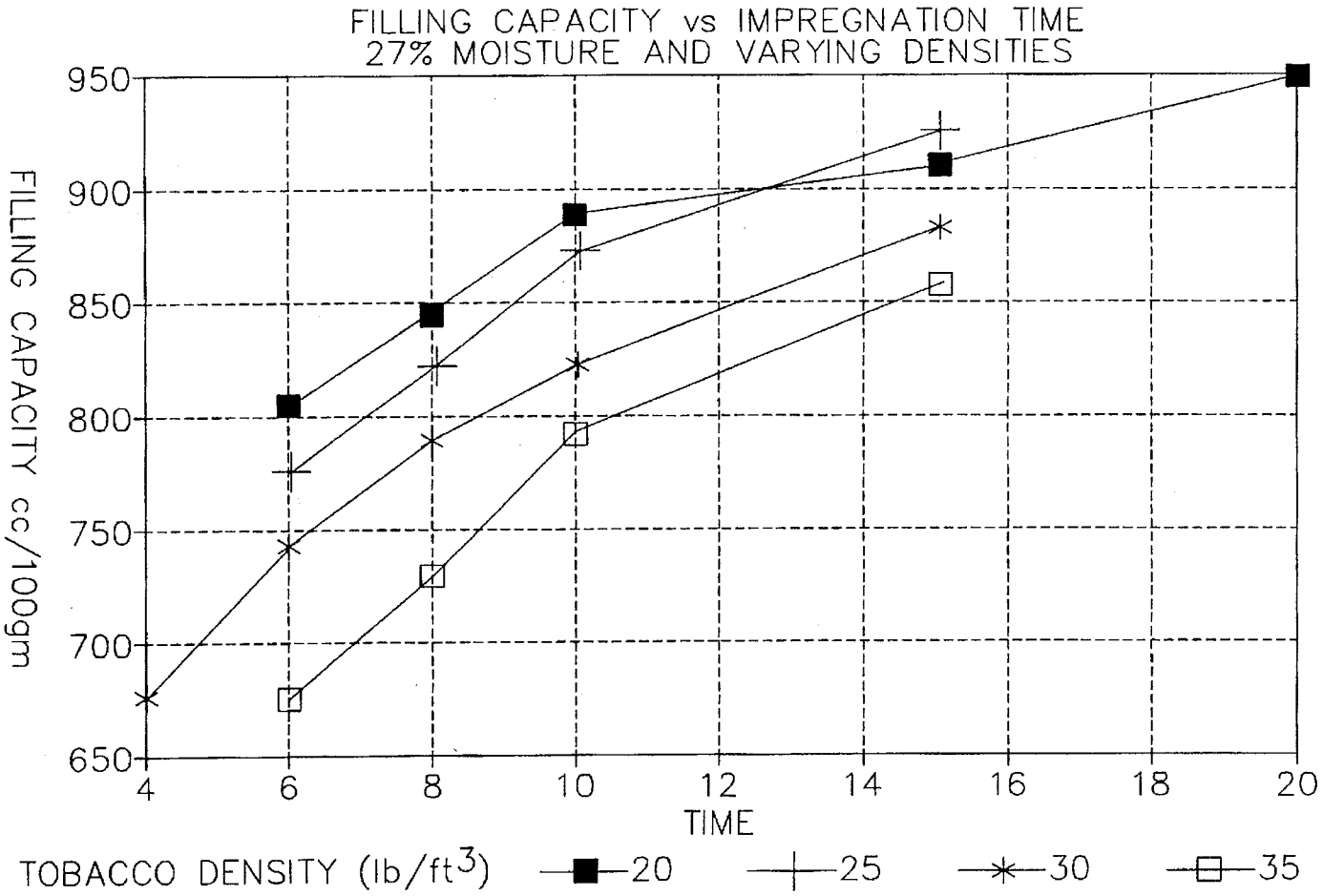
FIG. 14 is a graph illustrating how tobacco expansion can vary with different tobacco densities during impregnation by expansion agent and with different impregnation times.

FIG. 14 is a graph that illustrates how expansion can be varied by varying tobacco densities during impregnation and with different impregnation times. This graph illustrates impregnation of tobacco samples having a moisture content of 27 percent with propane at the same conditions described above. Impregnation times were varied from 4 seconds to 20 seconds. The tobacco samples which had an initial loose fill density of about 6.2 lb/cu.ft at 12% moisture and 76° F., were compressed to densities of 20, 25, 30, and 35 pounds per cubic foot (all densities calculated at or corrected to 12 percent moisture). As can be seen from FIG. 14, the degree of expansion increases with increased impregnation time and with decreasing compression of the tobacco. However excellent expansion is obtained even at high packing densities and short impregnation times of 10 seconds or even less.

Figure 15:
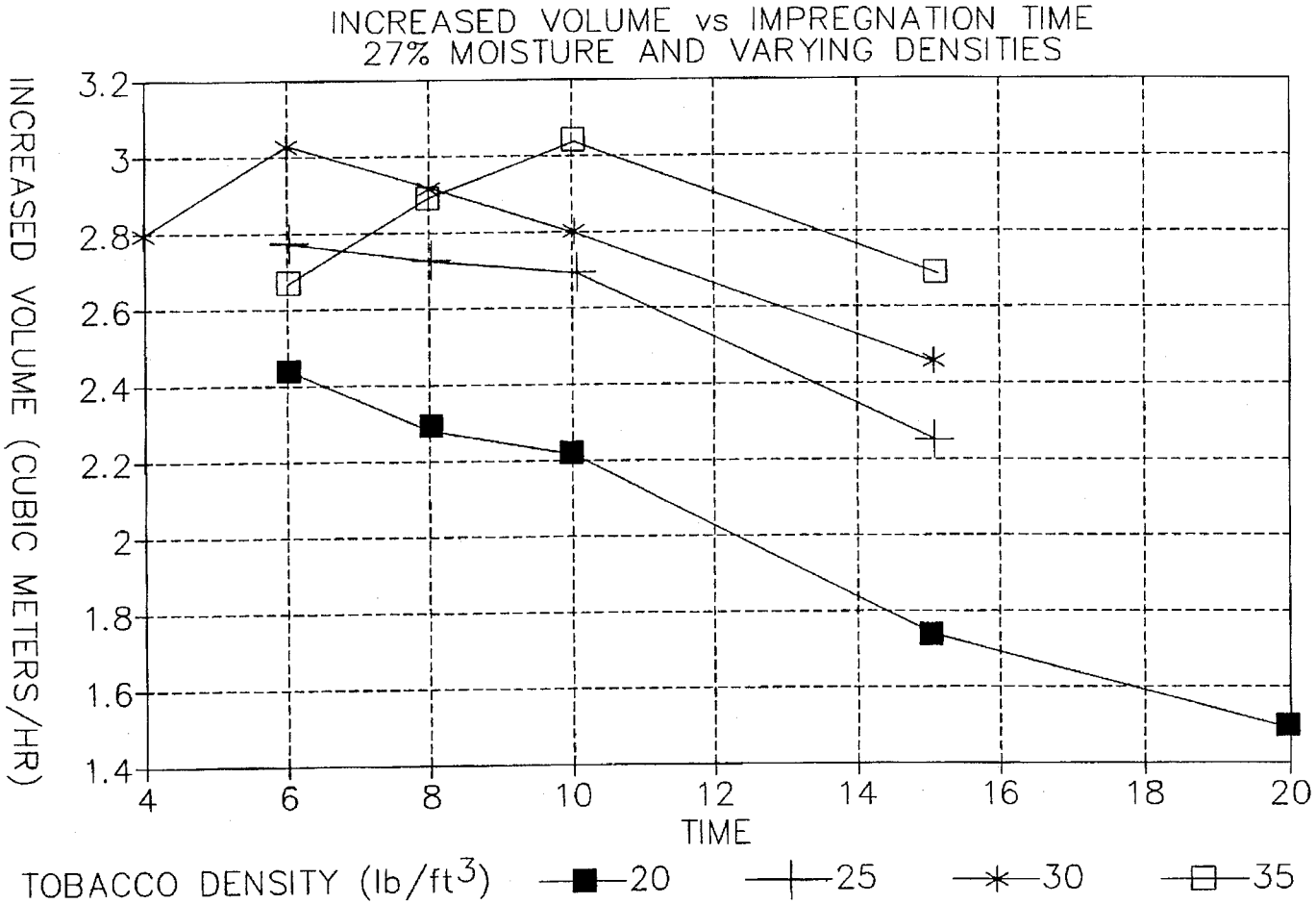
FIG. 15 is a graph derived from a composite of various expansion data to illustrate the flexibility of the expansion process and apparatus of the invention and depicts the total increase in tobacco volume per hour (in cubic meters per hour) which can be obtained from the apparatus of FIG. 1 as a function of impregnation time and tobacco compression.

FIG. 15 illustrates the flexibility of the expansion process and apparatus of the invention. This graph is a composite of various expansion data and illustrates the total increase in tobacco volume per hour (in cubic meters per hour) which can be obtained from the apparatus of FIG. 1 as a function of impregnation time and tobacco compression. This data assumes an available volume of space for occupation by tobacco of 400 cu. inches, and that the process is continuously operated at the cycle times shown. As is apparent, tobacco throughput is increased when cycle times are shortened and when tobacco compression is increased. As also seen in FIG. 15 the tobacco volume increase per hour is highest with short cycle times and increased tobacco compression. This is true because of the increased throughputs, and despite the fact that the amount of expansion for each batch of tobacco was not necessarily as high as could have been obtained at lower densities and/or with a longer cycle time. Thus the present invention provides a flexible process allowing variations in the degree of tobacco expansion and the degree of tobacco throughput.

The various aspects of the tobacco expansion processes described herein have been discussed specifically in connection with the use of propane as an expansion promoting impregnation agent and the use of impregnation temperature conditions near or above supercritical temperature together with conditions of elevated pressure approaching or above supercritical pressure, and in connection with preferred apparatus. It will be apparent that the processes and apparatus of the invention can be varied by numerous changes; for example, where recovery of expansion agent such as propane is not desired, the expansion agent can be burned following use thereof. In addition various significant tobacco expansion processes and apparatus disclosed herein, although particularly suited to tobacco expansion processes and apparatus employing high density expansion agent at supercritical temperatures and using short impregnation times, are also considered applicable to a wide variety of other differing tobacco expansion processes, expansion fluids, and apparatus.

Tobacco filling capacities when referred to herein, are measured in the normal manner using an electronically automated filling capacity meter in which a solid piston, 3.625 inches in diameter, is slideably positioned in a similarly sized cylinder and exerts a pressure of 2.6 lbs. per sq. in. for 5 seconds on a tobacco sample located in the cylinder. These parameters are believed to simulate the packing conditions to which tobacco is subjected in cigarette making apparatus during the formation of a cigarette rod. Measured tobacco samples having a weight of 50 g are used for expanded tobacco. Samples having a weight of 100 g are used for unexpanded tobacco.

Moisture values of tobacco samples are measured by placing a 100 g sample of tobacco in a wire mesh basket and then placing the basket into a forced air oven having an air temperature of about 200° F. for about 3 minutes. The tobacco and wire basket are weighed prior to and following heating in the oven and the weight loss expressed as percentage of tobacco weight prior to heating is reported as percent moisture.

The invention has been described in considerable detail with reference to preferred embodiments. However many changes, variations, and modifications can be made without departing from the spirit and scope of the invention as described in the foregoing specification and defined in the appended claims.

That which is claimed:

1. An accumulator for rapid supply of a first fluid at a density at or approaching the liquid density of the fluid comprising:

a pressure vessel having first and second zones adapted for separately maintaining two fluids under high pressure conditions, said vessel additionally comprising a third zone in fluid communication with each of the first and second zones for maintaining a barrier fluid in contact with each of the fluids in the first and second zones;

means for separately supplying fluids to each of said first, second and third zones; and means for supplying high pressure fluid from said third zone.

2. The accumulator of claim 1 additionally comprising level detectors for detecting the levels of the fluids in said second and third zones in said vessel.

3. The accumulator of claim 2 additionally comprising control means responsive to the level detectors for controlling said supply means for supplying fluid to said second zone.

4. The accumulator of claim 3 additionally comprising control means responsive to the level detectors for controlling said supply means for supplying fluid to said first zone.

5. The accumulator of claim 2 wherein said means for supplying fluid to said second zone comprises a water supply means.

6. The accumulator of claim 5 wherein said means for supplying fluid to said third zone comprises a propane supply means.

7. The accumulator of claim 6 wherein said means for supplying fluid to said first zone comprises a nitrogen supply means.

8. An apparatus for impregnating tobacco with a tobacco expansion agent for subsequent expansion of said tobacco comprising:

an impregnating chamber for impregnating tobacco with a predetermined quantity of impregnating agent under temperature and pressure conditions approaching or above supercritical;

a vessel containing a quantity of impregnating agent under temperature and pressure conditions approaching or above supercritical for discharge to said impregnating chamber;

a supply of impregnating agent for supplying impregnating agent to said vessel;

a high pressure pump for feeding said impregnating agent to said vessel; and said vessel being fluidly connected to said impregnating chamber for substantially instantaneously introducing said predetermined quantity of impregnating agent into said impregnating chamber under temperature and pressure conditions approaching or above supercritical, and wherein said quantity of impregnating agent is of a mass substantially greater than said predetermined quantity of said impregnating agent for impregnating tobacco in said impregnating chamber so that the introduction of said impregnating agent into said impregnating chamber from said vessel is accomplished with only a relatively small pressure drop in the impregnating agent maintained in said vessel.

9. The apparatus according to claim 8 wherein said pressure of said impregnating agent introduced into said impregnating chamber is greater than about 2,000 psig.

10. The apparatus according to claim 8 wherein said temperature of said impregnating agent introduced into said impregnating chamber is above about 125° F.

11. The apparatus according to claim 8 wherein said impregnating agent within said vessel has a predetermined density and said predetermined quantity introduced into said impregnating chamber changes said density by about 1 lb/sq.in. or less.

12. The apparatus according to claim 11 wherein said predetermined density is about 24 lb/cu.ft.

13. The apparatus according to claim 8 wherein said impregnating agent within said vessel has a predetermined density and said predetermined quantity introduced into said impregnating chamber changes said density by about 10% or less.

14. The apparatus according to claim 8 further comprising a heater for heating the impregnating agent within said vessel.

* * * * *